US007246811B2

(12) United States Patent
Martin

(10) Patent No.: US 7,246,811 B2
(45) Date of Patent: Jul. 24, 2007

(54) SNOWBOARD BINDING ENGAGEMENT MECHANISM

(75) Inventor: John D. Martin, Vashon, WA (US)

(73) Assignee: K-2 Corporation, Seattle, WA (US)

( * ) Notice: Subject to any disclaimer, the term of this patent is extended or adjusted under 35 U.S.C. 154(b) by 252 days.

(21) Appl. No.: 11/117,059

(22) Filed: Apr. 27, 2005

(65) Prior Publication Data

US 2006/0244241 A1 Nov. 2, 2006

(51) Int. Cl.
*A63C 9/00* (2006.01)

(52) U.S. Cl. ..... 280/611; 280/619; 280/621; 280/14.22

(58) Field of Classification Search ..... 280/611, 280/621, 623, 619, 14.22
See application file for complete search history.

(56) References Cited

U.S. PATENT DOCUMENTS

| | | | | |
|---|---|---|---|---|
| 5,454,140 | A | 10/1995 | Murai | |
| 5,727,797 | A | 3/1998 | Bowles | |
| 5,918,897 | A | 7/1999 | Hansen et al. | |
| 6,116,634 | A * | 9/2000 | Mometti | 280/613 |
| 6,283,495 | B1 * | 9/2001 | Phillips | 280/618 |
| 6,382,641 | B2 | 5/2002 | Dennis et al. | |
| 6,406,040 | B1 | 6/2002 | Thorne | |
| 6,467,795 | B1 | 10/2002 | Hirayama et al. | |
| 6,543,793 | B1 * | 4/2003 | Reuss et al. | 280/11.36 |
| 6,581,944 | B1 | 6/2003 | Marmonier et al. | |
| 6,609,720 | B2 | 8/2003 | Marmonier | |
| 6,648,365 | B1 | 11/2003 | Laughlin et al. | |
| 6,672,610 | B2 | 1/2004 | Freisinger et al. | |
| 6,736,413 | B2 * | 5/2004 | Laughlin et al. | 280/14.22 |
| 6,742,800 | B2 | 6/2004 | Okajima | |
| 6,938,913 | B2 | 9/2005 | Elkington | |
| 2004/0169350 | A1 * | 9/2004 | Elkington | 280/623 |

* cited by examiner

*Primary Examiner*—Christopher P. Ellis
*Assistant Examiner*—Katy Meyer
(74) *Attorney, Agent, or Firm*—Christensen O'Connor Johnson Kindness PLLC

(57) ABSTRACT

A snowboard binding (100) is disclosed having a base plate (102) with a highback (120) pivotally attached. A locking lever (130) is disposed on the back of the highback for locking the highback in a generally upright position with a desired maximum forward lean. A flexible member such as a strap (140) or a panel (202), cord guide (204), and cord (206) attached to the highback and to the locking lever to facilitate moving the lever between an open position and a locked position. In an embodiment of the invention, the base plate includes a pair of oppositely-disposed, pivotable sidewalls (104) and the highback is attached to the base plate with a heel loop (112) that pivotably engages the sidewalls, such that straps (108, 110) mounted to the sidewalls move to engage the boot (90) when the highback is moved to an upright position.

19 Claims, 9 Drawing Sheets

SNOWBOARD BINDING ENGAGEMENT MECHANISM

FIELD OF THE INVENTION

The present invention is in the field of bindings for sports equipment and, in particular, to bindings for snowboards.

BACKGROUND OF THE INVENTION

Gliding boards, primarily for sporting activities, are well known in the art and in the sporting world, including snowboards, snow skis, water skis, and the like. Various types of bindings have been developed to allow the user to engage the gliding board. The present disclosure is described with reference to the currently preferred snowboard binding embodiments, although the present invention may readily be adapted for other gliding board applications.

Conventional snowboard binding systems used with soft snowboard boots are generally categorized as either strap bindings that typically include a rigid highback piece against which the heel of the boot is placed and one or more straps that secure the boot to the binding, or step-in bindings that typically utilize one or more strapless engagement members into which the rider can step to lock the boot into the binding. Strap bindings are the original and most popular type of snowboard bindings and are adjustable, secure, and comfortable. Step-in bindings allow the user to more easily engage and disengage from the snowboard.

Both strap bindings and step-in bindings usually include a pivotable, highback ankle support that extends upwardly from the snowboard. The back ankle portion of the rider's boot abuts against a curved forward surface of the highback, essentially providing leverage by which the rider can control the snowboards heel edge. Alpine riders who need to perform high-speed turns generally prefer a taller and stiffer highback for greater edge control, wherein freestyle riders generally prefer a shorter highback for better flexibility. The angle that the highback forms with the snowboard, referred to herein as the maximum forward lean, is important to the feel and control of the snowboard. Generally, the maximum forward lean can be adjusted by the rider and will be set to a particular angle, depending on a variety of factors, including the type of snowboarding to be undertaken, the snow and slope conditions, and the like.

The mechanism for positioning the highback at a desired maximum forward lean typically includes a movable block that is locked into the desired position with a lever mechanism disposed on the back surface of the highback. Many bindings have a screw to remove and/or adjust the position of the lean block, while some utilize toolless adjustment, such as a lever or cam. For example, U.S. Pat. No. 5,727,797, to Bowles, which is hereby incorporated by reference in its entirety, discloses a snowboard binding assembly with a forward lean highback and having a lever-type quick release locking mechanism attached to a slideable block on the back of the highback. Similarly, a popular snowboard binding marketed by the assignee of the present application under the Cinch™ trademark utilizes a highback-mounted locking lever that also engages a cable connecting to pivotable sidewalls, such that the assembly simultaneously moves the highback and the instep strap into position about a rider's boot.

It will be appreciated that a rider must typically engage and disengage the binding many times over the course of a day of snowboarding, generally while the rider is on the slopes and, typically, with gloved hands. The binding is typically engaged and disengaged using a lever disposed on the back of the highback. The engagement lever is positioned on the rear surface of the highback and accessibility may be further limited by other gear and ice on the rider's gear. Each of these aspects increases the difficulty of moving the lever between the released and the locked position.

In addition, the lever can be difficult for the rider to grab because its position in the unlocked position is very low to the ground, near the surface of the snowboard. Therefore, it can be difficult to physically reach to the end of the lever to engage the binding. It will also be appreciated that it is desirable that the binding engagement lever have a low profile with respect to the highback, e.g., flush or minimally extending, when the lever is locked. The low-profile shape is not ideal for grabbing onto the lever for engagement or disengagement of the binding.

Prior art efforts to alleviate these difficulties include the user of larger, longer levers and/or adding rubber grips to the levers. These efforts, however, have proved ineffective or impractical. For example, larger levers add to the weight and expense of the binding and tend to expose the mechanism to external forces that may cause the lever to inadvertently disengage, and rubberized levers do not adequately address difficulties associated with accessing the lever.

Therefore, there remains a need to provide a lever locking mechanism for snowboard bindings that is easy to move to and from the locked position while on the slopes and with gloved hands.

SUMMARY OF THE INVENTION

A snowboard binding is disclosed having a base plate that attaches to a snowboard and a highback pivotably attached to the base plate. A locking lever is pivotably attached to the back of the highback and pivots between an open position, wherein the highback can pivot rearwardly to facilitate entry of the boot, and a locked position, wherein the highback is locked in an upright position to cooperatively secure the boot in the binding. A flexible member is attached at one end to the highback near the pivot end of the lever and at the other end to the locking lever, such that the rider can simply pull on the flexible member to move the lever between the open and locked positions.

In an embodiment of the invention, the flexible member is an elongate strap made from a polymeric material, such as nylon.

In an embodiment of the invention, the binding includes a U-shaped heel loop and pivotable sidewalls that are connected to the highback such that when the highback is pivoted to an open position, instep and toe straps on the sidewalls move away from the base plate to further facilitate entry into the binding, and when the highback is pivoted to an upright position—that is, when the locking lever is moved to the locked position—the straps move downwardly to engage the rider's boot.

In an embodiment of the invention, the binding includes a cable having a first end that is attached to one sidewall, a second end that attaches to the other sidewall and extends around the highback to engage cable guides mounted to the heel loop. The cable also engages the locking lever, such that moving the lever to the locked position tensions the cable to facilitate locking the binding in a closed position.

In an embodiment of the invention, the flexible member includes a semirigid panel that extends upwardly from the locking lever, the panel including a cord guide. A cord is attached to the locking lever and extends through an aperture in the cord guide, such that the rider can move the lever between the open and locked positions by pulling on the cord. The cord may include a graspable member on its distal end.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
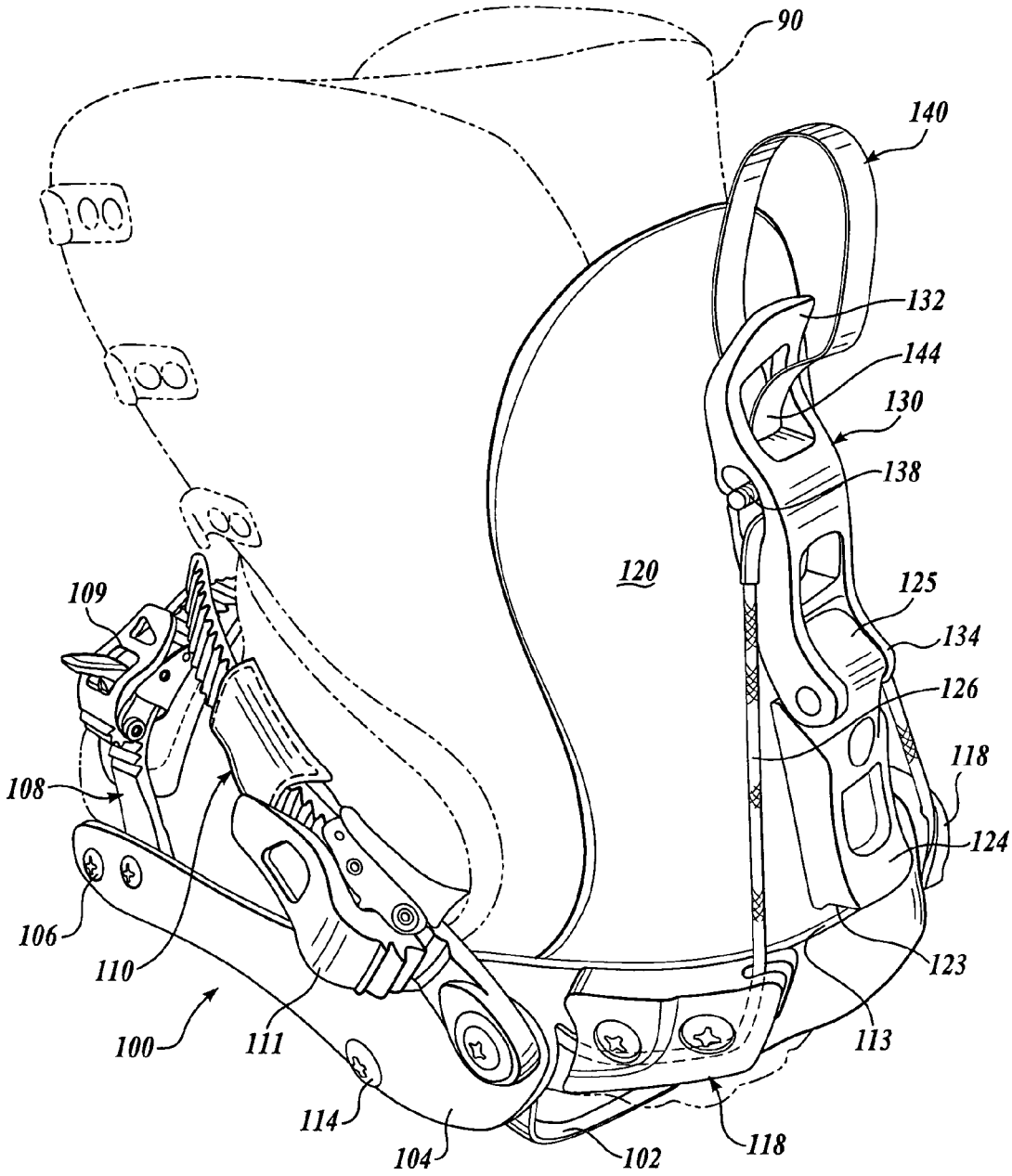
FIG. 1 is a three-quarter back perspective view of an embodiment of a snowboard binding, according to the teachings of the present invention.
Figure 2A:
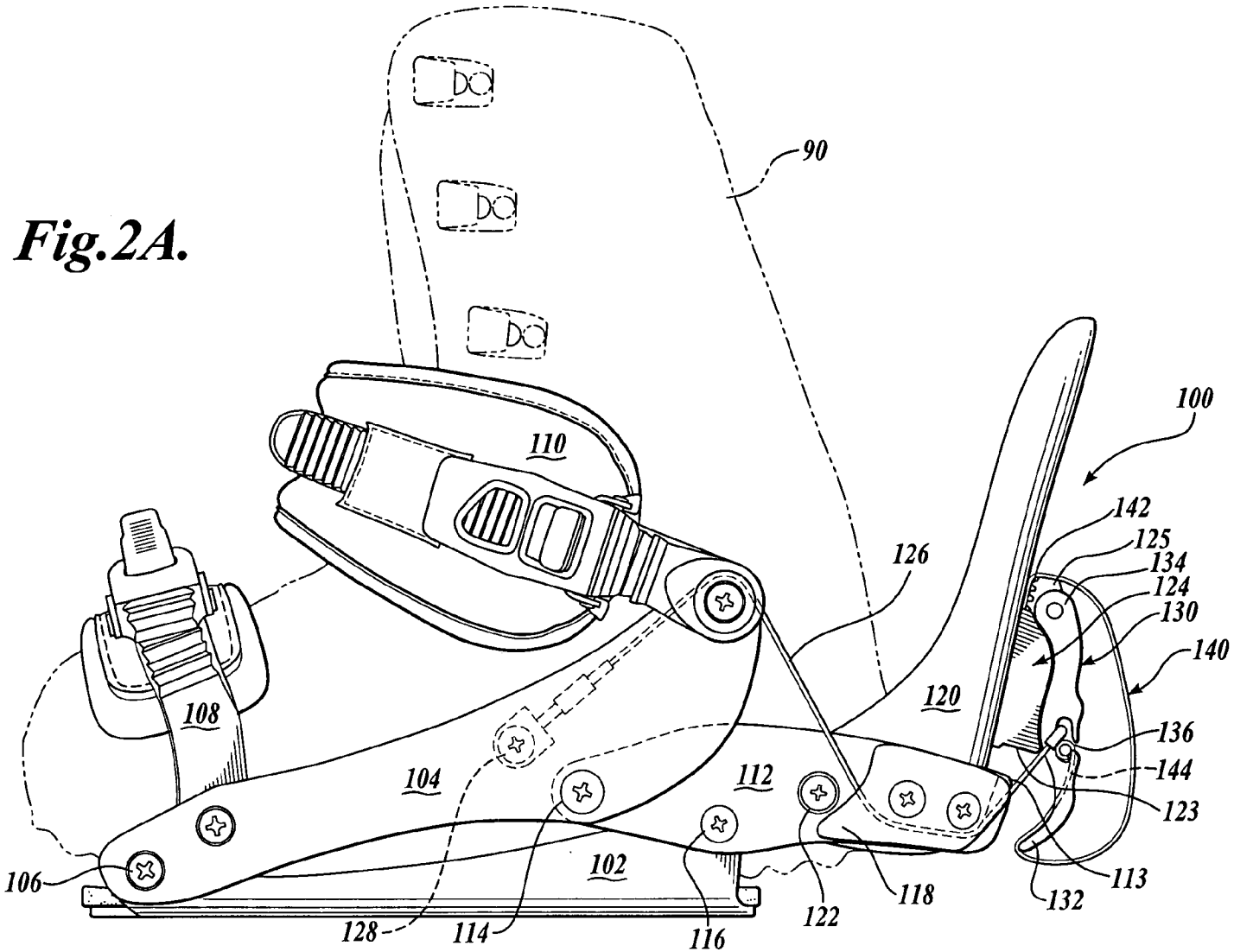
FIG. 2A is a side view of the snowboard binding shown in FIG. 1, with the highback in the full open position.

Refer now to the figures, wherein like numbers indicate like parts. A perspective view of a first preferred embodiment of a snowboard binding 100 according to the present invention is shown in FIGS. 1 and 2A-2C. The binding 100 includes a base plate 102 that is adapted to be attached to the upper surface of a snowboard (not shown) in a conventional manner. Typically, the position and orientation of the base plate 102 on the snowboard may be adjusted to suit the rider and the types of runs that the rider plans to make. A pair of oppositely disposed sidewall members 104 (one visible in FIGURES) is pivotally attached with a pivot member 106 near a forward end of the base plate 102. A toe strap 108 and an instep strap 110 are attached to the sidewall members 104, and include latching mechanisms 109, 111, respectively, such that the straps 108, 110 cooperate to secure the rider's boot 90 (shown in phantom) to the binding 100. A U-shaped heel loop 112 is pivotably attached on both sides with pivot members 114 to the sidewall members 104. The heel loop 112 is also pivotably attached on both sides to the base plate 102 with pivot members 116 (FIG. 2A, one shown). In this embodiment, the binding 100 also includes a pair of oppositely disposed cable guides 118 that is fixedly attached to the heel loop 112.

A pivoting highback 120, contoured to approximately conform to the back of the rider's boot 90, extends upwardly from a pair of oppositely disposed pivotal attachment members 122 (FIG. 2A, one shown) connecting the highback 120 to the heel loop 112. A blocking member 124 is adjustably attached to the back of the highback 120. The blocking member 124 has a lower end 123 that is positioned to abut an upper edge 113 of the heel loop 112, limiting the backward rotation of the highback 120 relative to the heel loop 112. The maximum angle between the highback 120 and the base plate 102 (the maximum forward lean) may be selectively established from a range of maximum angles by slidably adjusting the position of the blocking member 124 on the highback 120.

A locking lever 130 is pivotably attached to the blocking member 124 near its upper end 125. The locking lever 130 is movable between an open position rotated away from the highback 120 (shown in FIG. 2A) and a locked position rotated to be generally adjacent the back surface of the highback 120 (shown in FIG. 2C). A cable 126 extends from a fixed attachment 128 to one sidewall member 104, rearwardly and around the highback 120 slidably engaging one of the cable guide members 118 on the heel loop 112 through a slot 136 in the lever 130, then slidably engages the other cable guide member 118 and attaches to the other sidewall member 104 (not shown).

The locking lever 130 further comprises a mechanism to facilitate engagement and disengagement of the locking lever 130. For example, as seen most clearly in FIGS. 2A, 2B, and 2C, a flexible strap 140 is provided having a first end portion 142 that is attached near a proximal end 134 of the lever 130, and a second end portion 144 that engages the lever 130 at an intermediate location and extends over the distal end 132 of the lever 130. In the current embodiment the first end portion 142 of the flexible strap 140 is fixed to the binding 100 between the blocking member 124 and the highback 120. The second end portion 144 of the flexible strap 140 is removably attached to the locking lever 130 with a post 138 that extends through a loop formed in the second end portion 144 of the flexible strap 140 and through the slot 136 in the lever 130. Other conventional attachment means can obviously be utilized without departing from the present invention.

Figure 2B:
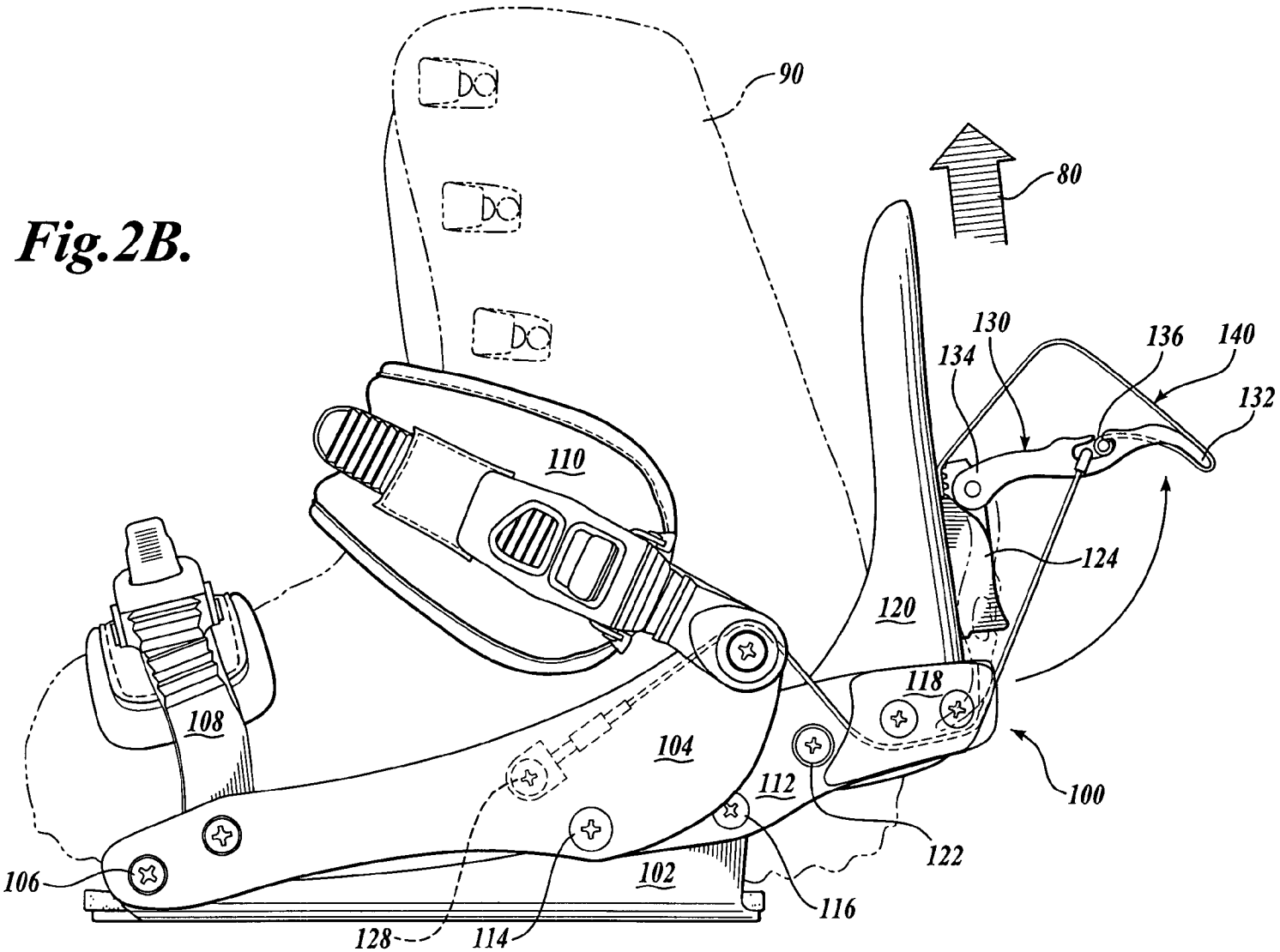
FIG. 2B is a side view of the snowboard binding shown in FIG. 1, with the highback in a partially closed position.
Figure 2C:
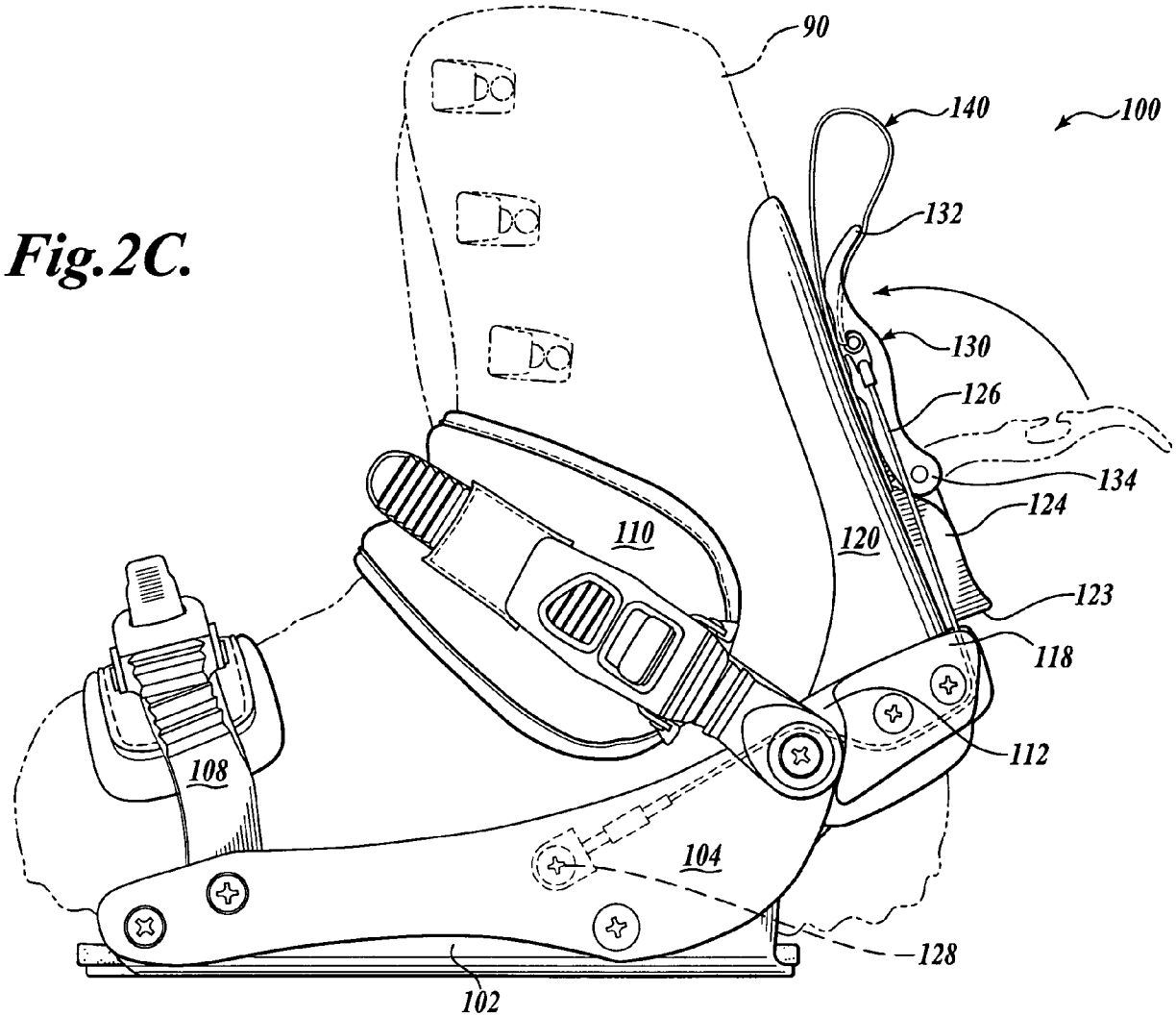
FIG. 2C is a side view of the snowboard binding shown in FIG. 1, with the highback in the locked position.

The general operation of the binding 100 can now be understood, with particular reference to FIGS. 2A, 2B, and 2C, which show side views of the binding 100, in an open position (FIG. 2A), partially closed position (FIG. 2B), and a locked position (FIG. 2C). In the open position, the lever 130 distal end 132 is disposed away from the highback 120 and the highback 120 is pivoted outwardly to facilitate entry of the boot 90 into the binding 100. In the binding 100, as the highback 120 pivots outwardly the heel loop 112 pivots (clockwise in FIG. 2A) about the pivot member 116, which causes the sidewall members 104 to pivot (counterclockwise in FIG. 2) about pivot member 106, moving the straps 108, 110 away from the base plate 102 to further facilitate the boot 90 entry into the binding 100.

After inserting a boot 90, the rider pulls upwardly on the strap 140, as indicated by the arrow 80 in FIG. 2B, to pivot the highback 120 generally towards the boot 90. The movement of the heel loop 112 causes the sidewall members 104 to pivot downwardly, such that the straps 108, 110 move toward the boot 90. The locking lever 130 may now be placed in the locked position shown in FIG. 2C by continuing to pull the strap 140 upwardly and forwardly, causing the distal end 132 of the lever 130 to pivot towards the highback 120. It will be appreciated that lever 130 pulls the cable 126 upwardly, producing an upward force on the cable guides 118, thereby pivoting the heel loop 112 (counterclockwise in FIG. 2C) to the desired position. Typically, the strap latching mechanisms 109, 111 have previously been set to a desired setting and the straps 108, 110 will be securely tightened about the boot 90 by engagement of the lever 130. Alternatively, the rider may elect to adjust the latching mechanisms 109, 111 after moving the lever 130 to the locked position.

As discussed above, due to the position of the locking lever 130 on the back of the highback 120 and the typical need to engage the locking lever 130 while on the slope and usually while wearing gloves, in prior art bindings it can be difficult to reach the distal end 132 of the locking lever 130 to move the locking lever 130 to the locked position. The flexible strap 140 provides a large, easily-engaged loop through which a rider can readily extend one or more fingers of a gloved hand. The rider then simply pulls inwardly and upwardly on the flexible strap 140 to pivot the lever 130 from the open position shown in FIG. 2A to the locked position shown in FIG. 2C. Also, the rider does not need to try to grasp the lever 130 or to extend a gloved finger behind the distal end 132 of the lever 130 for disengagement. Rather, the rider can easily disengage the locking lever 130 using the large loop formed by the strap 140 and pulling rearwardly. For example, the loop may be grabbed as a whole to pull rearwardly to disengage the lever, or the rider can insert a finger in the loop and pull rearwardly. In particular, the rider does not have to get a gloved hand behind the lever 130 that is held in tension against the highback 120 in order to disengage the lever 130. The strap 140 also makes it easier to move the lever 130 to the locked position, because the rider does not need to get under the end of the lever 130, which is very close to the ground (e.g., the surface of the snowboard) in the open position.

The flexible strap 140 is lightweight and easily installed. In particular, it will be appreciated that the flexible strap 140 permits the use of a smaller locking lever 130 because the locking lever does not have to be engaged directly by the gloved hands of the rider. The flexible strap may be made from any suitably strong material that is able to withstand the low temperature and icy conditions encountered in snowboarding. In a current embodiment, the flexible strap 140 is made from a rugged polymeric material, such as nylon.

Figure 3:
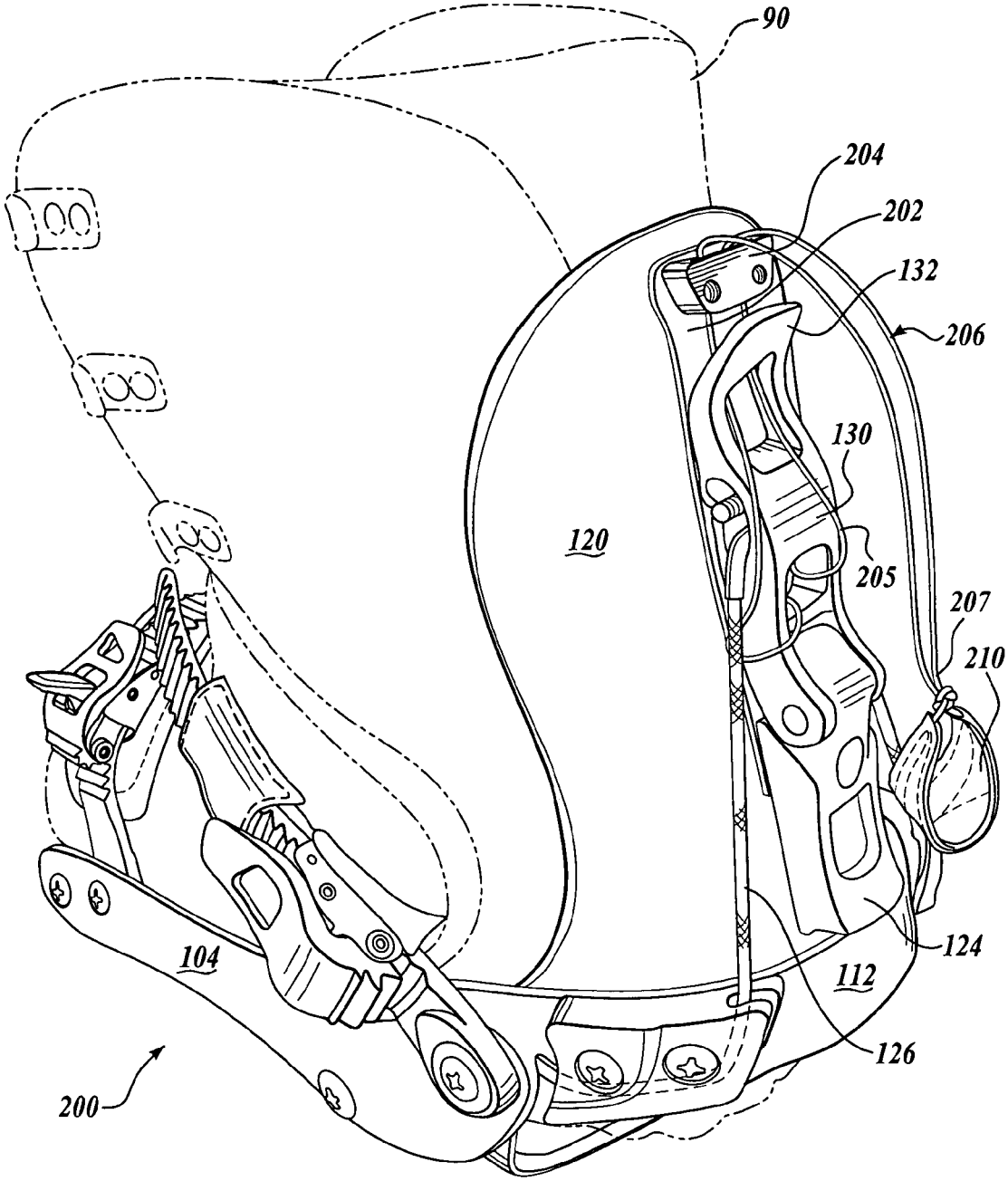
FIG. 3 is a perspective view of a second embodiment of a snowboard binding according to the teachings of the present invention.

Referring now to FIGS. 3 and 4A-4C, a second embodiment of the present invention is shown. FIG. 3 shows a perspective view of a binding 200, similar to the binding shown in FIG. 1. Except for the lever engagement mechanism, the second embodiment of the binding 200 is identical to the binding 100 described above. In general, aspects of the binding 200 of this second embodiment are the same as the binding 100 shown in FIG. 1 and will not be repeated here for brevity and clarity.

In this second embodiment, a semirigid, flexible panel 202 is attached to the back of the highback 120. The proximal end of the panel 202 is fixed between the blocking member 124 and the highback 120 and extends upwardly from the blocking member 124. A guide element 204 defining an aperture therethrough is attached to the distal end of the flexible panel 202. One end portion 205 of a flexible cord 206 is attached to the locking lever 130 at an intermediate position on the locking lever 130. The cord 206 extends upwardly through the aperture in the guide element 204. A relatively large, graspable element 210 is attached at a second end portion 207 of the cord 206. In the current embodiment, the graspable element 210 is a sewn leather loop, although other suitable materials may be used—including, for example, a polymeric material, a sturdy fabric element, and the like. The cord 206 may be formed from a natural fiber or synthetic material, for example, or metal cable or the like.

Figure 4A:
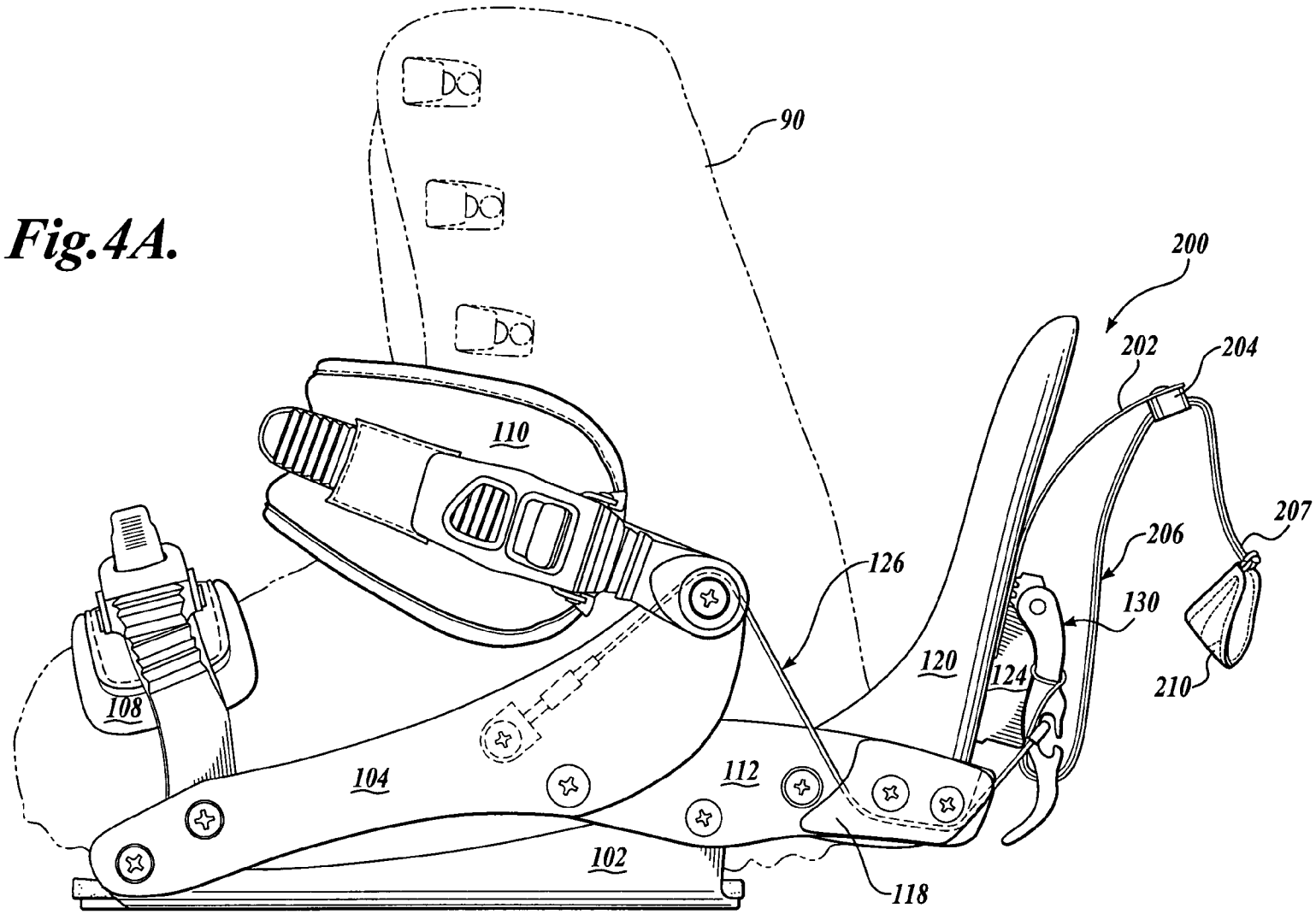
FIG. 4A shows a side view of a second embodiment of a snowboard binding, according to the teachings of the present invention.
Figure 4B:
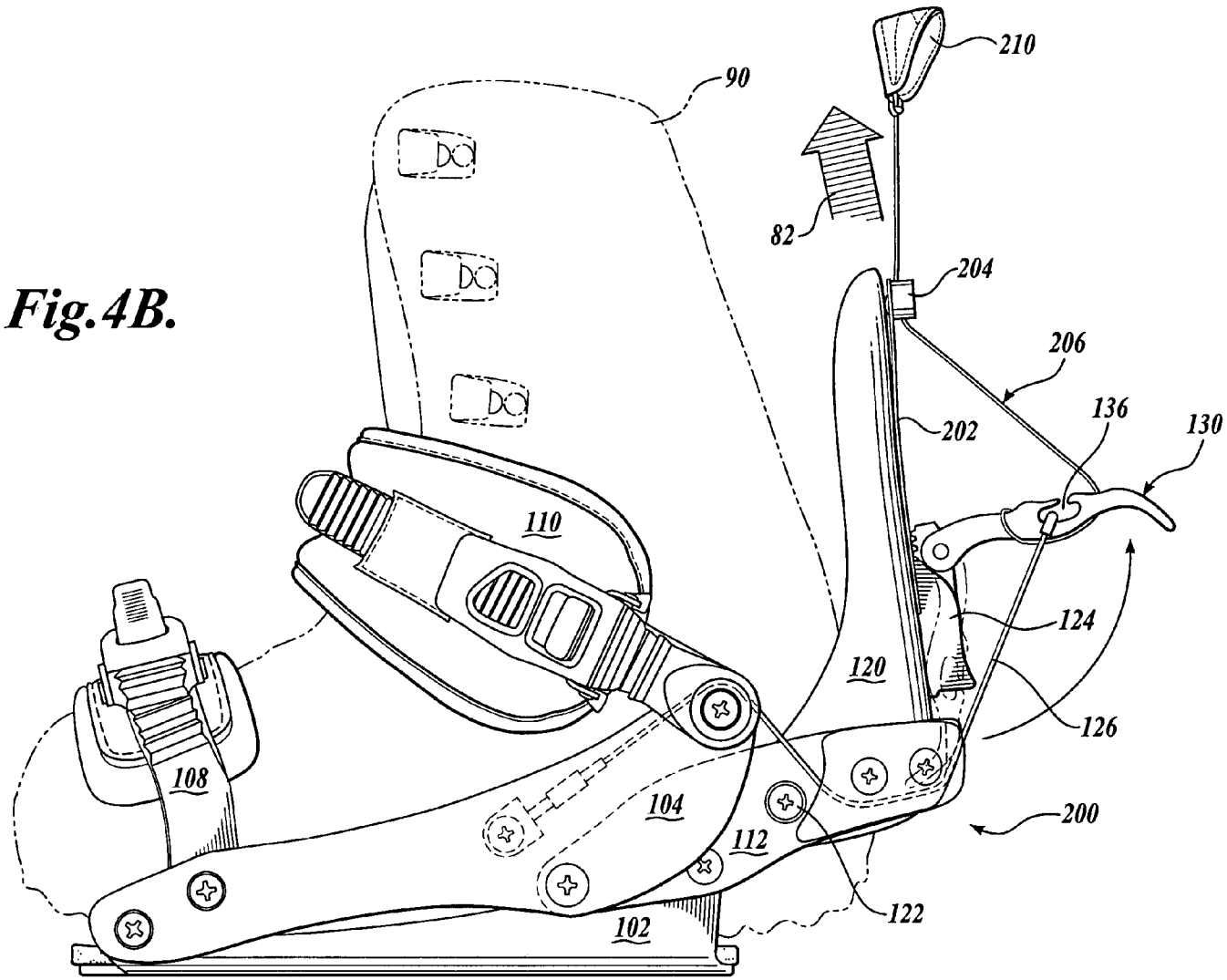
FIG. 4B is a side view of the snowboard binding shown in FIG. 3A, with the highback in a partially closed position.
Figure 4C:
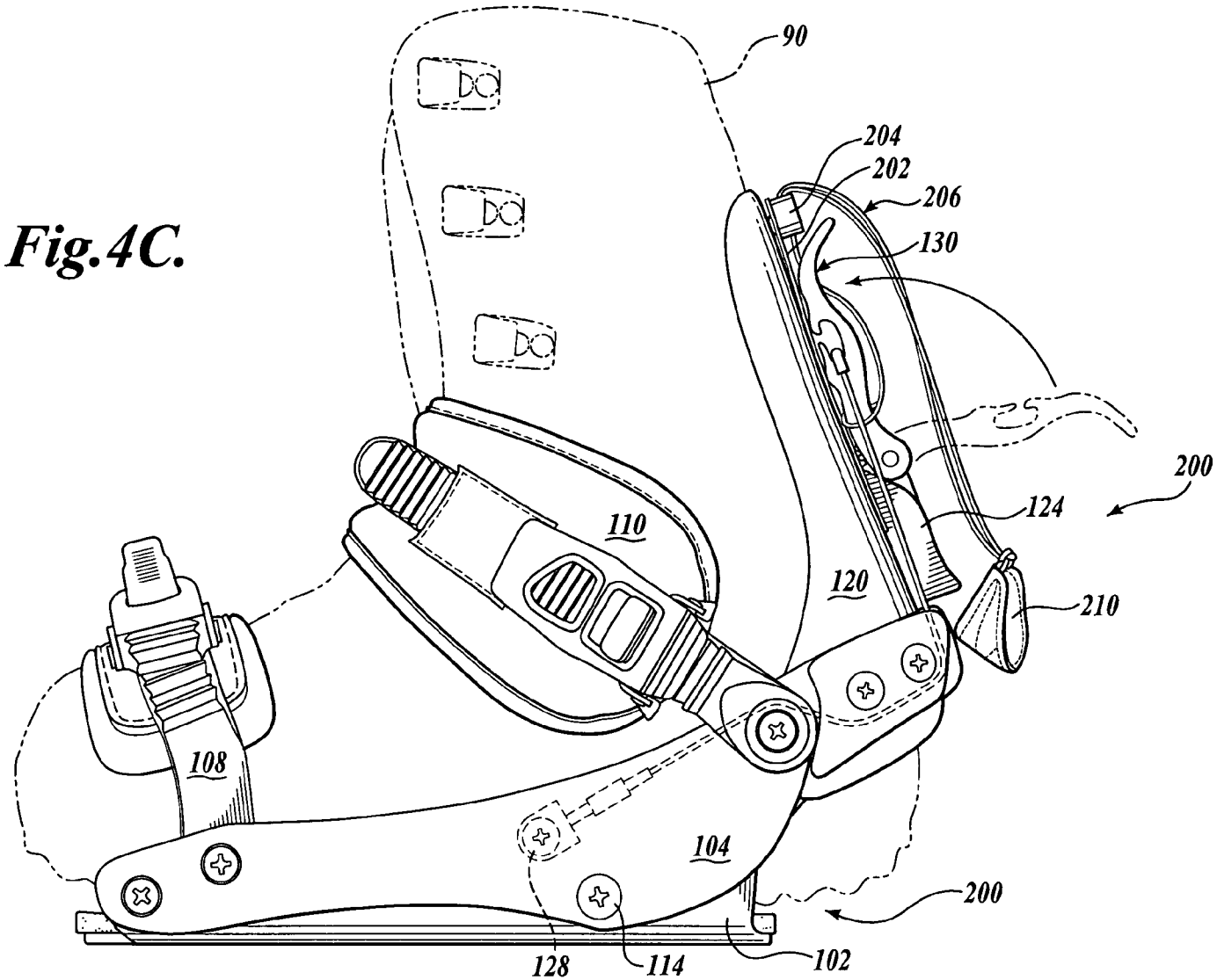
FIG. 4C is a side view of the snowboard binding shown in FIG. 3A, with the highback in the locked position.

Refer now in particular to the side views of the binding 200 shown in FIGS. 4A-4C, these figures sequential showing stages in the engagement of the binding 200. To mount the snowboard, the rider typically first opens the binding 200 by rotating the highback 120 rearwardly, generally to the position shown in FIG. 4A. Rotating the highback 120 causes the sidewalls 104 to pivot about the pivot member 106, such that the straps 108 and 110 move away from the base plate 102, as discussed above. The rider then inserts a boot 90 onto the base plate 102, sliding the boot 90 generally to a forward position, and pulls upwardly and inwardly on the graspable element 210, as indicated by the arrow 82 in FIG. 4B. The cord 206 pulls the lever 130 upwardly, pivoting the highback 120 toward the maximum forward lean position. The rider pulls the graspable element 210 until the lever 130 locks into the locked position shown in FIG. 4C. As previously discussed, the sidewalls 104 move the straps 108, 110 into place over the rider's boot 90, to secure the boot 90 in place.

To disengage the binding 200, the rider pulls generally rearwardly on the graspable element 210, causing the panel 202 to exert a rearward force on the distal end of the lever 130, pivoting the lever 130 toward the open position. The rider then pivots the highback 120 rearwardly to remove the boot 90.

It will now be appreciated that the flexible panel 202 provides two functions. First, it aids in the release of the lever 130 when the lever 130 is in the locked position and under tension by pushing against the end of the lever 130 when the rider pulls rearwardly on the graspable element 210. Also, it aids in moving the lever 130 into the locked position by effectively extending the point of where the lever is held, increasing the leverage gain. Although the flexible panel 202 in the disclosed embodiment is fixed between the blocking member 124 and the highback 120, other similar constructions are possible without departing from the present invention. For example the flexible panel 202 may be integrally formed with the blocking member, attached directly to the highback, or removably attached to the binding 200.

Figure 5:
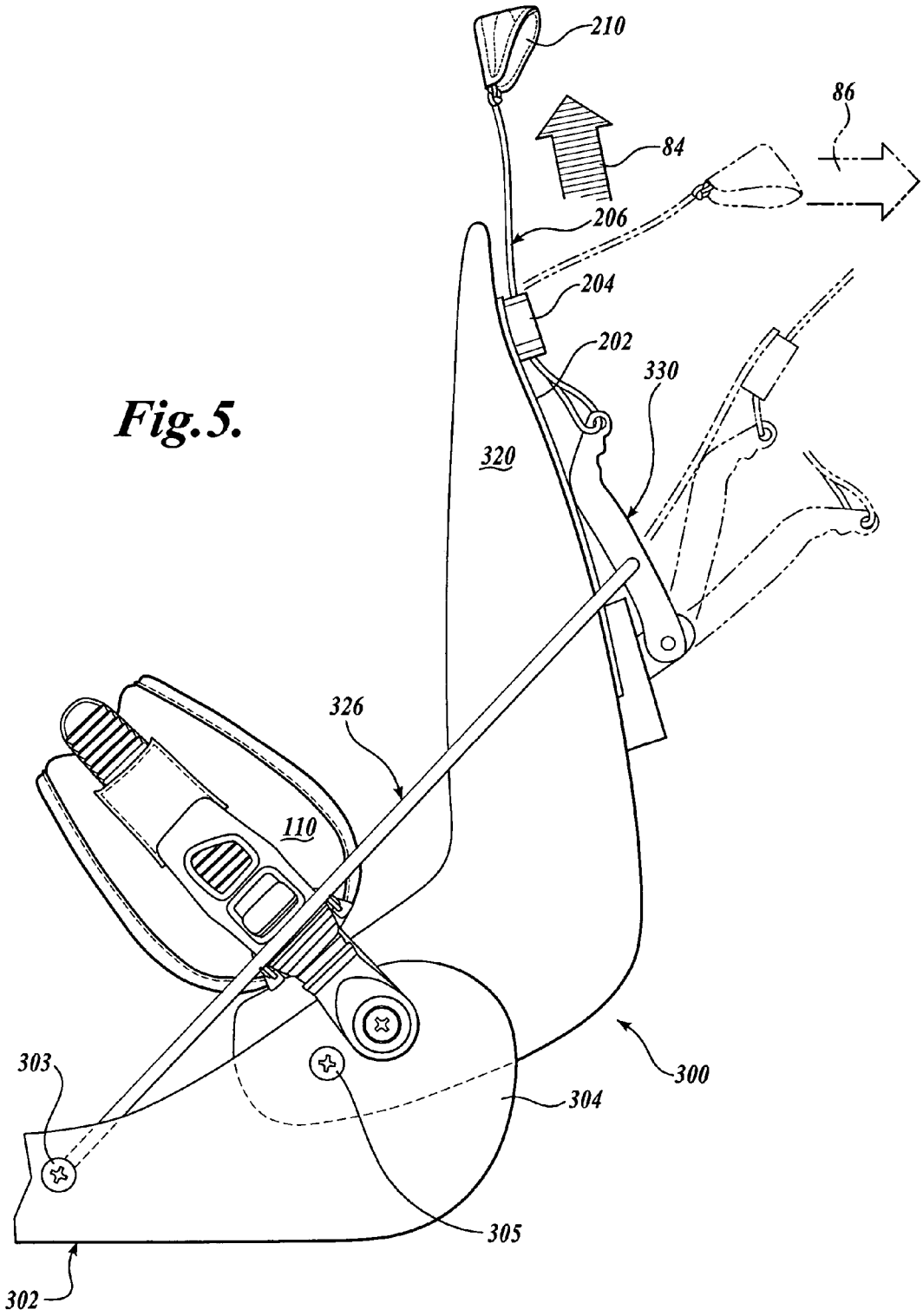
FIG. 5 is a partial side view of a third embodiment of a snowboard binding according to the teachings of the present invention.

A third embodiment of the present invention is shown in FIG. 5, which shows a side view of the rearward portion of a binding 300 having a base plate 302 with a pair of oppositely-disposed, fixed sidewalls 304 (one shown) that may be formed as integral parts of the base plate 302 or fixedly attached to the base plate 302. In this embodiment of the binding 300, the sidewalls 304 are not pivotable and the highback 320 is pivotably attached directly to the sidewalls 304 by a pivot member 305. A separable heel loop is not required. A cable 326 extends from a fixed attachment at an intermediate position 303 on one of the sidewalls 304, rearwardly and behind the highback 320 to slidably engage a locking lever 330, and around to the sidewall 304 on the opposite side (not visible). The locking lever 330 is movable between a locked position, shown in FIG. 5, and an open position, shown in phantom. Typically, the cable 326 effective length is adjustable—for example, with a threadable attachment at 303 (not shown)—and provides a mechanism for controlling the maximum forward lean of the highback 320. When the locking lever 330 is in the open position, the highback 320 can pivot about the pivot member 305 away from the base plate 302 (clockwise in FIG. 5), allowing the rider to insert a boot under the instep strap 110 and into the binding 300.

The mechanism to facilitate engaging (locking) and disengaging the lever 330 is essentially the same as that shown in FIG. 3. In particular, a flexible panel 202 extends upwardly, generally from the base of the lever 330. A cord guide 204 is disposed at the distal end of the panel 202. A cord 206 is attached near the end of the lever 330 and extends upwardly through the guide 204. A graspable element 210 is attached to the opposite end of the cord 206. The rider can therefore pull upwardly and forwardly, as indicated by the arrow 84 in FIG. 5, to move the lever 330 into the locked position. When disengaging from the binding 300, the rider can pull basically rearwardly on the graspable element 210 to pivot the lever 330 to the open position, and then pivot the highback 320 rearwardly.

It will be apparent from the present disclosure that the binding 300 may alternatively utilize the flexible strap 140 shown in FIGS. 1 and 2A-2C and attached to the highback 320 and lever 330 rather than the cord 206 to facilitate engagement and disengagement of the locking lever 330.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A binding comprising:

a base plate adapted to be attached to a snowboard;

a highback pivotably attached to the base plate;

a locking lever having a proximal end pivotably attached to a back side of the highback and a distal end, the locking lever being pivotable between an open position wherein the distal end is disposed away from the highback and a locked position wherein the distal end is disposed near the highback; and a flexible member having a first portion attached to the highback near the proximal end of the locking lever and a second portion attached to the locking lever at a position away from the proximal end of the locking lever;

wherein the locking lever is movable from the open position to the locked position by pulling upwardly on the flexible member.

2. The binding of claim 1, wherein the flexible member comprises an elongate strap.

3. The binding of claim 2, wherein the elongate strap is formed from a polymeric material.

4. The binding of claim 2, further comprises a U-shaped heel loop that is pivotably attached to the base plate and wherein the highback is pivotably attached to the base plate with the heel loop.

5. The binding of claim 4, wherein the base plate comprises a base portion and a pair of oppositely-disposed sidewalls are pivotably attached to the base portion, the sidewalls supporting an adjustable instep strap therebetween, and wherein the sidewalls are also pivotably attached to the heel loop such that pivoting the heel loop on the base plate will cause the sidewalls to pivot.

6. The binding of claim 5, wherein the binding further comprises a cable having a first end that is attached to one sidewall, a second end that attaches to the other sidewall, and wherein the cable extends around the highback and engages the locking lever.

7. The binding of claim 6, further comprising at least one cable guide fixedly attached to the heel loop, wherein the cable engages the cable guide.

8. The binding of claim 7, wherein when the locking lever is in the locked position, the cable is in tension and arranged such that the cable exerts an upward force on the heel loop cable guide.

9. The binding of claim 7, further comprising a blocking member that is adjustably attached to the highback such that a lower end of the blocking member abuts an upper edge of the heel loop.

10. The binding of claim 1, wherein the flexible member comprises a semirigid panel that extends upwardly from the proximal end of the locking lever, the semirigid panel having a cord guide with an aperture, and a cord having a first end that is attached to the locking lever, the cord extending through the aperture in the cord guide.

11. The binding of claim 10, wherein the flexible member further comprises a graspable member that is attached to a second end of the cord.

12. The binding of claim 11, wherein the graspable member is a leather loop.

13. The binding of claim 11, further comprises a U-shaped heel loop that is pivotably attached to the base plate, and wherein the highback is pivotably attached to the base plate with the heel loop.

14. The binding of claim 13, wherein the base plate comprises a base portion and a pair of oppositely-disposed sidewalls pivotably attached to the base portion, the sidewalls supporting an adjustable instep strap therebetween, and wherein the sidewalls are also pivotably attached to the heel loop such that pivoting the heel loop on the base plate will cause the sidewalls to pivot.

15. The binding of claim 14, wherein the binding further comprises a cable having a first end that is attached to one sidewall, a second end that attaches to the other sidewall, and wherein the cable extends around the highback and engages the locking lever.

16. The binding of claim 15, further comprising at least one cable guide fixedly attached to the heel loop, wherein the cable engages the cable guide.

17. The binding of claim 16, wherein when the locking lever is in the locked position the cable is in tension and arranged such that the cable exerts an upward force on the heel loop cable guide.

18. The binding of claim 16, further comprising a blocking member that is adjustably attached to the highback such that a lower end of the blocking member abuts an upper edge of the heel loop.

19. A snowboard binding comprising:

a base plate having a base portion adapted to be attached to a snowboard and oppositely-disposed sidewalls;

a highback pivotably attached to the oppositely-disposed sidewalls;

a locking lever pivotably attached to the highback, the locking lever being movable between an open position and a locked position;

a cable having a first end attached to one of the oppositely-disposed sidewalls and a second end attached to the other of the oppositely-disposed sidewalls, the cable extending through a slot in the locking lever;

a semirigid panel attached to the highback, the semirigid panel having a cord guide attached thereto; and a cord having a first end attached to the locking lever and a second end having a graspable member, the cord extending through the cable guide;

wherein the lever can be moved from the open position to the locked position by pulling upwardly on the graspable member.

* * * * *